US006085995A

United States Patent [19]

Kah, Jr. et al.

[11] Patent Number: 6,085,995

[45] Date of Patent: Jul. 11, 2000

[54] SELECTABLE NOZZLE ROTARY DRIVEN SPRINKLER

[76] Inventors: Carl L. C. Kah, Jr., 778 Lakeside Dr.; Carl L. C. Kah, III, 12166 West End, both of North Palm Beach, Fla. 33408

[21] Appl. No.: 09/104,456

[22] Filed: Jun. 24, 1998

[51] Int. Cl.[7] ..... B05B 3/04

[52] U.S. Cl. ..... 239/237; 239/240; 239/390; 239/392; 239/393; 239/394; 239/436; 239/DIG. 1

[58] Field of Search ..... 239/237, 240, 239/390, 391, 392, 393, 394, 436, 437, DIG. 1

[56] References Cited

U.S. PATENT DOCUMENTS

| | | | |
|---|---|---|---|
| D. 388,502 | 12/1997 | Kah, III | D23/214 |
| 3,083,872 | 4/1963 | Meshberg | 222/42 |
| 3,094,283 | 6/1963 | Balister | 239/393 |
| 3,526,363 | 9/1970 | Hauser | 239/206 |
| 3,645,451 | 2/1972 | Hauser | 239/206 |
| 3,762,650 | 10/1973 | Radecki | 239/396 |
| 4,624,412 | 11/1986 | Hunter | 239/232 |
| 4,625,914 | 12/1986 | Sexton et al. | 239/206 |
| 4,717,074 | 1/1988 | Karliner et al. | 239/288 |
| 4,784,325 | 11/1988 | Walker et al. | 239/204 |
| 4,867,378 | 9/1989 | Kah, Jr. | 239/206 |
| 4,901,924 | 2/1990 | Kah, Jr. | 239/242 |
| 5,098,021 | 3/1992 | Kah, Jr. | 239/242 |
| 5,104,045 | 4/1992 | Kah, Jr. | 239/246 |
| 5,226,599 | 7/1993 | Lindermeir et al. | 239/205 |
| 5,417,370 | 5/1995 | Kah, Jr. | 239/242 |
| 5,526,982 | 6/1996 | McKenzie | 239/240 |
| 5,653,390 | 8/1997 | Kah, Jr. | 239/242 |
| 5,695,123 | 12/1997 | Le | 239/240 X |
| 5,765,757 | 6/1998 | Bendall | 239/205 |
| 5,823,440 | 10/1998 | Clark | 239/240 X |
| 5,826,797 | 10/1998 | Kah, III | 239/394 |

FOREIGN PATENT DOCUMENTS

| | | | |
|---|---|---|---|
| 2313132 | 12/1976 | France | 239/394 |
| 975101 | 11/1982 | U.S.S.R. | 239/390 |

*Primary Examiner*—Andres Kashnikow
*Assistant Examiner*—Robin O. Evans
*Attorney, Agent, or Firm*—Jack N. McCarthy

[57] ABSTRACT

A rotary drive sprinkler having a multiplicity of nozzles which can be selectively changed at any time. The nozzle assembly has an internal rotor member for bringing one of the nozzles into operation as the internal rotor is turned. A water flow can be directed from a rotor to a selected nozzle in a fixed circumferential row of nozzles to create a nozzle stream leaving the nozzle assembly, or a nozzle stream can be directed from a specific nozzle of a circumferential row of nozzles in an internal rotor to a single passage open to the exterior of the nozzle assembly.

40 Claims, 6 Drawing Sheets

SELECTABLE NOZZLE ROTARY DRIVEN SPRINKLER

TECHNICAL FIELD

This invention relates to rotary drive sprinklers with multiple nozzles of differen flow rates and discharge trajectories that can be selectably changed at any time including when the sprinkler is installed or when the sprinkler is operating.

BACKGROUND ART

In U.S. Pat. No. 5,098,021 an integrated system is set forth for varying the flow rate of a single nozzle combination to meet precipitation rate requirements for varying arcs of oscillating coverage.

U.S. Pat. No. 5,104,045 relates to sprinkler nozzles for rotary drive sprinklers having multiple flow passages for obtaining desired precipitation coverage. This patent shows how a single nozzle is typically installed and retained in oscillating sprinkler nozzle housings.

U.S. Pat. No. 4,867,378 shows a rotary drive sprinkler device for directing a flow of water therefrom having a nozzle combination in a nozzle housing assembly with pattern coverage control.

U.S. Pat. No. 5,526,982 has a matrix of small nozzles that can be selectively turned on to vary the flow rate and provide a composite stream from a matrix of small nozzles.

U.S. patent application Ser. No. 08/405,033 now U.S. Pat. No. 5,826,797 to Carl L. C. Kah, III for OPERATIONALLY CHANGEABLE MULTIPLE NOZZLES SPRINKLER is included here as if fully set forth and provides for change from one nozzle to another that can be carried by the rotary drive sprinkler nozzle housing or separately installed while the sprinkler is operating.

Other rotary drive sprinklers in the market place have separate nozzles of different flow rates or trajectories but can only be installed into the sprinkler nozzle housing when the sprinkler is not operating. In order to change to a new desired nozzle, the undesired nozzle which was installed in the sprinkler's housing must also be removed before the new desired replacement nozzle can be installed.

Other patents setting forth a background for this invention are: U.S. Pat. Nos. 3,094,283; 3,526,363; 3,645,451; 3,762,650; 4,235,379; 4,624,412; 4,625,914; 4,717,074; 4,901,924; 5,226,599; 5,335,859; 5,417,370; 5,653,390; and Russian Patent No. 975,101 and French Patent No. 2,313,132.

DISCLOSURE OF INVENTION

It is an object of this invention to make it possible to select a nozzle for the desired range and flow rate by turning a nozzle selection shaft in the nozzle housing rotating an internal nozzle selection rotor to have a nozzle of the desired flow rate and stream elevation angle or ranges moved into the water supply flow path or the flow path moved to a selected nozzle to provide the desired precipitation rate while the sprinkler is operating or off. Nozzle identification for flow rate, range, and precipitation rate or reference indicies for use with charts is provided on the top of the nozzle housing to aid in selecting the desired nozzle while using the rotary nozzle selection shaft.

After installation if it is found that a local area of the yard needs more or less water from that of the other sprinklers running in that irrigation zone, it is only necessary to rotate the multiple nozzle selection rotor to a different flow rate or trajectory nozzle to provide an increased or decreased precipitation for this area of the yard even while the sprinkler system is operating.

Also, the sprinkler may be shut off at the sprinkler by turning the nozzle selection member to a blank rotational position.

This concept makes it simple to adjust the flow rate for the arc of oscillation that is set to provide a particular precipitation rate or to increase or decrease the sprinkler's flow rate to better match the precipitation to varying soil or sunlight conditions (shade) after the installation has been completed and the landscaping has been stabilized.

Also, this concept would allow pre-manufacturing groups of different flow rate nozzles which give the same distance of coverage from the sprinkler at a particular pressure level; i.e., 30 feet for one group, 40 feet for another group.

An object of the invention is to provide a rotary sprinkler having a nozzle housing assembly with an internal rotatable nozzle rotor member with a selection of nozzles having one or more discharge openings around its circumference for allowing selection of one of the nozzles for directing flow from the nozzle housing to provide the desired range and flow rate.

Arcuate angle of coverage around the sprinkler is determined by the arc of oscillation that the sprinkler drive is set to oscillate the nozzle through, i.e., 90°, 180°, 270°, 360°, or angle as set.

A further object of this invention is to provide a stream outlet opening as part of the housing and having an internal nozzle rotor which contacts said housing to align a nozzle with said stream outlet opening being made of an elastomeric material to permit the rotor to provide a seal with said housing by having the water pressure press said rotor against the housing.

Another object of this invention is to provide a nozzle selection mechanism for selecting one of a plurality of preformed nozzles on the top of the nozzle housing assembly and an arc indicating and setting mechanism to change the arc of oscillation of a sprinkler and indicate it on the top of the nozzle housing assembly.

A further object of the invention is to provide a rotary sprinkler having a nozzle housing assembly with a plurality of nozzles being selectable by an internal rotor for directing flow to one of the nozzles for exiting from the sprinkler.

Another object of the invention is lo provide a nozzle housing assembly with an internal rotatable nozzle rotor having a plurality of nozzles which can be rotated between a nozzle stream outlet opening and a flow inlet deflector to form different nozzles.

A further object of the invention is to provide a selection of nozzles around the circumference of an internal rotor which can be rotated to open one of these nozzles to a stream outlet opening in the housing. This arrangement exposes only the selected nozzle to the outside.

Another object of the invention is to provide a flexible strip of nozzles for a nozzle housing assembly to place internally in a ring of a plurality of exit openings around a nozzle housing.

A further object of the invention is to provide a rotary sprinkler having a nozzle housing assembly with a plurality of nozzles and having a top with an indicator for selecting and indicating one of a plurality of nozzles selected and an indicator for selecting and indicating the arc of oscillation set.

Another object of the invention is to provide a rotary sprinkler having a provision at its top for setting the arc of oscillation at an intermediate point which allows for finer adjustment of the arc set.

BEST MODE FOR CARRYING OUT THE INVENTION

Figure 1:
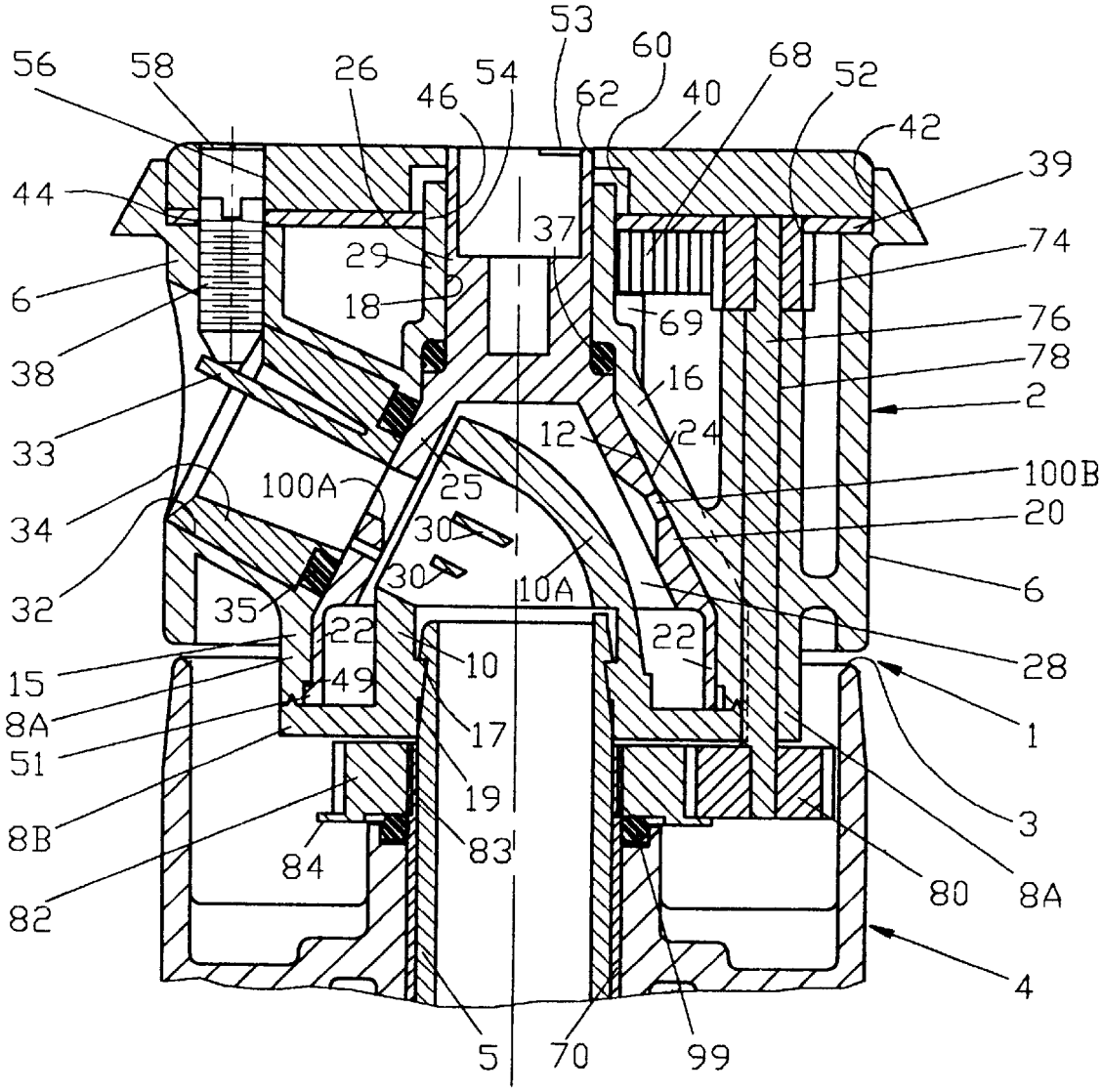
FIG. 1 is a side view in section of the upper part of a rotary drive sprinkler having a plurality of nozzles around the circumference of a rotatable conical nozzle selection member internally mounted in the nozzle housing for aligning a desired nozzle of the plurality of nozzles with a single stream outlet opening in the nozzle housing taken along the line 1—1 of FIG. 2 showing the nozzle housing assembly mounted on the top of a riser.
Figure 2:
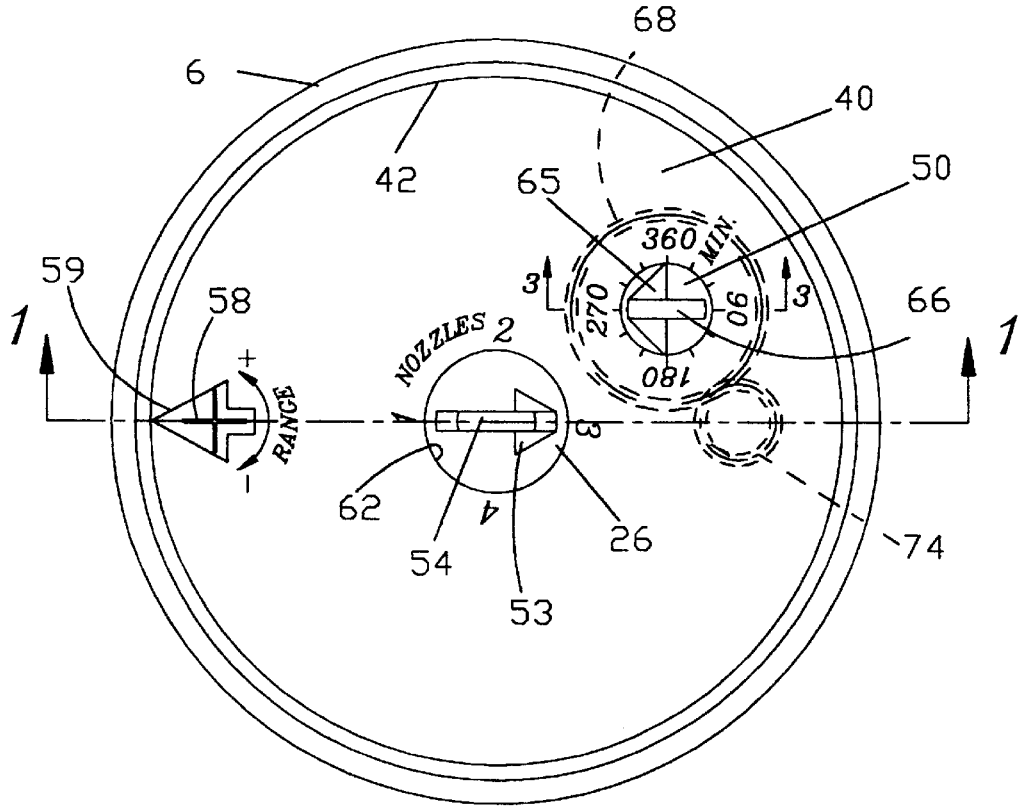
FIG. 2 is a top view of the rotary drive sprinkler shown in FIG. 1.

Referring to FIG. 1 and FIG. 2 of the drawings, an upper portion of a rotatable sprinkler 1 is shown having a cylindrical nozzle housing assembly 2 mounted for rotation about axis x—x on top of a riser assembly 4. The riser assembly 4 has an opening 3 at its upper end for a nozzle housing assembly output drive shaft 5 to exit the riser assembly 4 and be connected to the nozzle housing assembly 2. An arc set indicating and setting mechanism is included to set the cylindrical nozzle housing assembly 2 at a specific arc of oscillation.

The cylindrical nozzle housing assembly 2 has an outer cylindrical nozzle housing 6 which has a bottom portion 8A and 8B. The center of the bottom portion 8A and 8B extends into the opening 3 at the upper end of the riser assembly 4 and bottom portion 8B has an opening member 10 extending up-wardly therefrom to receive the drive shaft 5 extending from the riser assembly 4. The drive shaft 5 is fixed in the opening member 10 in a manner to be hereinafter described. The bottom portion 8A extends outwardly to form the outer cylindrical nozzle housing 6 and upwardly to form inner nozzle rotor chamber 12. The inner nozzle rotor chamber 12 extends upwardly as a short cylindrical section 15, then as a hollow conical section 16 tapering inwardly ending in a cylindrical opening 18 in a cylindrical sleeve 29. A rotatable nozzle rotor 20 is positioned in the rotor chamber 12 and has rotary sliding contact with the side of the inner nozzle rotor chamber 12. There is no sealing required between the rotatable nozzle rotor 20 and the inside of the rotor chamber 12 and clearance ribs around the surface of the nozzle rotor 20 may be provided to maintain the nozzle rotor 20 centered while reducing the sliding friction between nozzle rotor 20 and stationary side of the rotor chamber 12. The lower portion of the nozzle rotor 20 is formed as a cylindrical flange 22 engaging short cylindrical section 15 of the nozzle rotor chamber 12. The mid-portion of the nozzle rotor 20 is formed as a hollow frustum 25 of a cone with a conical surface 24 facing the conical section 16 of the nozzle rotor chamber 12. A cylindrical extension 26 extends upwardly from the end of the mid-portion of the nozzle rotor 20 to engage the cylindrical opening 18. An inner flow chamber 28 is formed within cylindrical flange 22 and the hollow frustum 25 of a cone.

The bottom portion 8B is fixed to bottom portion 8A by sonic welding. Other known means can be used to fix these parts together. Drive shaft 5 is fixed in the opening member 10 by a snap fit at 17 and rotationally locked against rotation by a splined connection 19 therebetween. Opening member 10 extends into a flow turning member IOA with vanes 30 to direct the water flow from hollow drive shaft 5 to a nozzle inlet with minimum turbulence to enhance nozzle stream range in directing the stream flow away from the sprinkler nozzle housing. Turning member 10A may be made as a separate part or left out entirely when the flow area of the hollow drive shaft 5 is relatively large, compared to that of the nozzle flow area.

The hollow conical section 16 of the inner nozzle rotor chamber 12 has a nozzle stream outlet opening 32 extending to the outside of the nozzle housing and upwardly at an angle to the outer surface of cylindrical nozzle housing 6. A seal retention insert 34 is positioned in said stream outlet opening 32 to retain a seal 35 between the rotatable nozzle rotor 20, and the nozzle housing at the stream outlet opening 32. This seal could take many other forms such as having the insert 34 made of an elastomer with an end lip or enhanced contact surface molded onto its surface for engaging the rotatable nozzle rotor 20. Seal 35 could be a standard "0"-ring, as shown, or a quad seal. The seal retention insert 34 has a stream deflector 33 extending from the inner end of the seal retention insert 34 outwardly to the exit of the stream outlet opening 32. The stream deflector 33 can be integrally molded with the seal retention insert 34. A stream deflector screw 38 serves to obtain a change in flow pattern (range, angle) as directed through seal retention insert 34 by controlling the stream deflector 33 and prevents the seal retention insert 34 from being dislodged during operation.

The rotatable nozzle rotor 20 has a plurality of nozzles 100 around the circumference of the conical mid-portion. Nozzles 100A and 100B are shown. These nozzles 100 are arranged around the rotatable nozzle rotor 20 so that they become aligned with the nozzle stream outlet opening 32 as the nozzle rotor 20 is rotated. The cylindrical extension shaft 26 of the rotatable nozzle rotor 20 extends through the cylindrical opening 18 to the top surface of a rubber cover 40 to be hereinafter described. The cylindrical extension shaft 26 has a nozzle selection recess 54 to receive a key (or flat screwdriver) for turning the rotatable nozzle rotor 20 within the nozzle rotor chamber 12 to align a designated nozzle 100 with the nozzle stream opening 32.

This nozzle selection recess 54 has an arrowhead 53 formed at one end of the recess 54 to point at a number (or other indicia) displayed on the rubber cover 40 around the cylindrical extension 26 to indicate which nozzle 100 is aligned with the nozzle stream opening 32. In FIG. 2 it can be seen that the arrowhead 53 is pointing at the numeral 3 which indicates the nozzle being used. As the arrowhead 53 points at nozzle 3, the nozzle 100A is aligned with the nozzle stream opening 32.

The short cylindrical section 15 of the nozzle rotor chamber 12 and the cylindrical flange 22 of the rotatable nozzle rotor 20 have a cooperating mechanism therebetween for holding the nozzle rotor 20 in a temporary position where one of the nozzles 100 is properly aligned with the nozzle stream opening 32 in the nozzle rotor chamber 12 until force is applied through the nozzle selection recess 54 to move the nozzle rotor 20 to another desired nozzle position.

The cooperating mechanism is a small rounded notch 49 directed inwardly at the bottom of the short cylindrical section 15 below and in alignment with the nozzle stream opening 32, and a small rounded projection 51 directed outwardly at the bottom of the cylindrical flange 22 in alignment with a nozzle 100. The rounded notch 49 and rounded projection 51 are sized to engage when a nozzle 100 is properly aligned with the nozzle stream opening 32.

This engagement of a rounded projection 51 and rounded notch 49 provides a "feel" for the person setting the nozzle selection recess 54; as the arrowhead 53 points to a desired nozzle 100, when proper alignment occurs, the engagement of projection 51 and notch 49 can be "felt". When a nozzle 100 is not properly aligned, the projection 51 rides on the normal bottom width of the cylindrical section 15.

Figure 3:
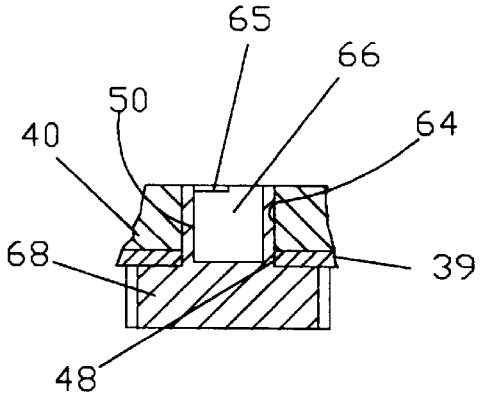
FIG. 3 is a view taken on the line 3—3 of FIG. 2.

The cylindrical nozzle housing assembly 2 has a top as shown in FIG. 2. A recess 42 extends around the upper end of the cylindrical nozzle housing 6 and receives a plate 39 and the rubber cover 40. The plate 39 provides rigidity for the rubber cover 40 and is attached to the nozzle housing 6 by sonic welding or other attachment. The plate 39 has openings where required:

(1) an opening 44 for a stream deflector screw 38;
(2) an opening 46 for the cylindrical sleeve 29;
(3) an opening 48 for an arc set cylinder 50 to be hereinafter disclosed (see FIG. 3);
(4) an opening 52 for the upper end of an arc set intermediate gear shaft and gear to be hereinafter described.

The rubber cover 40 is fixed in the recess 42 with the plate 39 by rubber holding plugs fitting into holes in the plate 39 (not shown); other holding devices can be used. An opening 56 in rubber cover 40 is aligned with opening 44 in the plate 39 to access stream deflector screw 38 through a slit 58 in the rubber cover 40. An "arrow" 59 indicates the position of the stream outlet opening 32. An opening 60 in the rubber cover 40 permits the cylindrical sleeve 29 to extend into the rubber cover 40. Tie cylindrical extension shaft 26 with its nozzle selection recess 54 extends through an opening 62 to the top surface of the rubber cover 40. The arc set indicating cylinder 50 extends through an opening 64 in the rubber cover 40 aligned with opening 48 in plate 39 to the top surface of the rubber cover 40.

A recess 66 in the arc set indicating cylinder 50 is formed to receive a key (or flat screwdriver) for turning the arc set indicating cylinder 50. Recess 66 has an arrowhead 65 formed at one end of the recess 66 to point to numbers around the arc set indicating cylinder 50 to indicate the arc of oscillation which has been set, or the change of oscillation being set. The arc set indicating cylinder 50 has a gear 68 mounted thereon under the plate 39 to transmit the movement of the arc set indicating cylinder 50 by the recess 66 to an arc set shaft 70 in the riser assembly 4 mounted for rotation around the nozzle housing assembly output drive shaft 5. Gear 68 is supported in the nozzle housing assembly by a portion 69 of the nozzle housing 6.

The arc set indicating and setting mechanism comprises the arc set indicating cylinder 50 and attached gear 68. The gear 68 meshes with a gear 74 mounted on the top of a shaft 76. Shaft 76 is supported in a tube 78 which extends upwardly from bottom portion 8A of outer cylindrical nozzle housing 6 to just below the gear 74 to support it. The bottom of the shaft 76 extends into the riser assembly 4 below tube 78 and has a gear 80 mounted on the end thereof. The arc set shaft 70 mounted around the nozzle housing assembly output drive shaft 5 has a gear 82 mounted by splines 83 on the top thereof meshing with gear 80. Gear 80 is supported in the riser assembly 4 by a cylindrical flange 84 around the bottom of meshing gear 82. An "O"-ring seal 99 is located between the arc set shaft 70 and part of the riser assembly 4 as a dirt seal.

It can be seen that as the arc set indicating cylinder 50 is rotated to change the arc through which the nozzle housing assembly rotates, the gear 68 also rotates thereby turning gear 74, shaft 76, and gear 80. Gear 80 turns gear 82 and arc set hollow shaft 70 thereby changing the angular position of nozzle housing assembly output drive shaft 5 and the arc set hollow shaft 70. These shafts 5 and 70 are connected to a mechanism to control the arc of oscillation set. Such an arc set control mechanism is shown in U.S. Pat. No. 4,901,924, issued Feb. 20, 1990, and this patent is incorporated herein by reference as though fully set forth.

The rotatable nozzle rotor 20 is placed in the rotor chamber 12 in the nozzle housing 6 during assembly of the nozzle housing assembly 2 and the bottom portion 8A and 88 are fixed together, such as by sonic welding.

Figure 4:
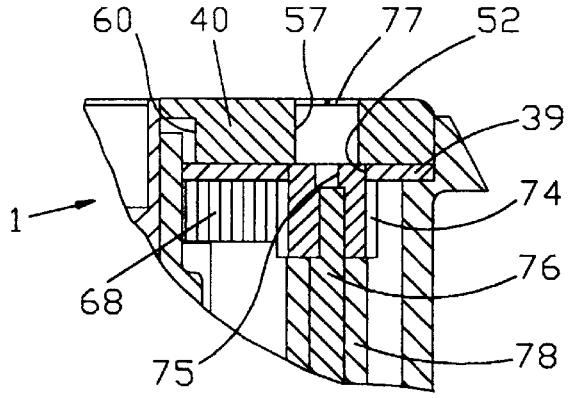
FIG. 4 is a fragmentary view in section of a portion of FIG. 1 showing an alternate configuration for setting the arc of oscillation and setting the arc set cylinder which indicates the arc set.

As shown in FIG. 4, the rotatable sprinkler 1 can have an additional control at its top for setting the arc of oscillation at an intermediate point between the top surface of the rubber cover 40 and riser assembly 4 which allows for finer adjustment of the arc set. The rubber cover 40 has an opening 57 aligned with opening 52 in plate 39 which holds the upper end of arc set intermediate gear shaft 76 and gear 74. A key slot 75 is formed in the top end of the intermediate gear shaft 76 and gear 74 and a slit 77 is provided in the rubber cover 40 to access the key slot 75 through the opening 57. It can be seen that the direct rotation of the intermediate gear shaft 76 by key slot 75 gives a finer adjustment of the arc set mechanism. Further movement of the gear 74 will rotate gear 68 to indicate the arc set on arc set indicating cylinder 50.

An "O"-ring seal 37 is placed between the bottom of the cylindrical extension 26 and the cylindrical opening 18.

This invention is applicable to rotary drive sprinklers that have full circle rotation or oscillation rotation and that achieve this by reversing turbine, reversing gear cages of various configurations, intermediate drives, or ratchet drives that cause the nozzle housing to be rotated.

Figure 5:
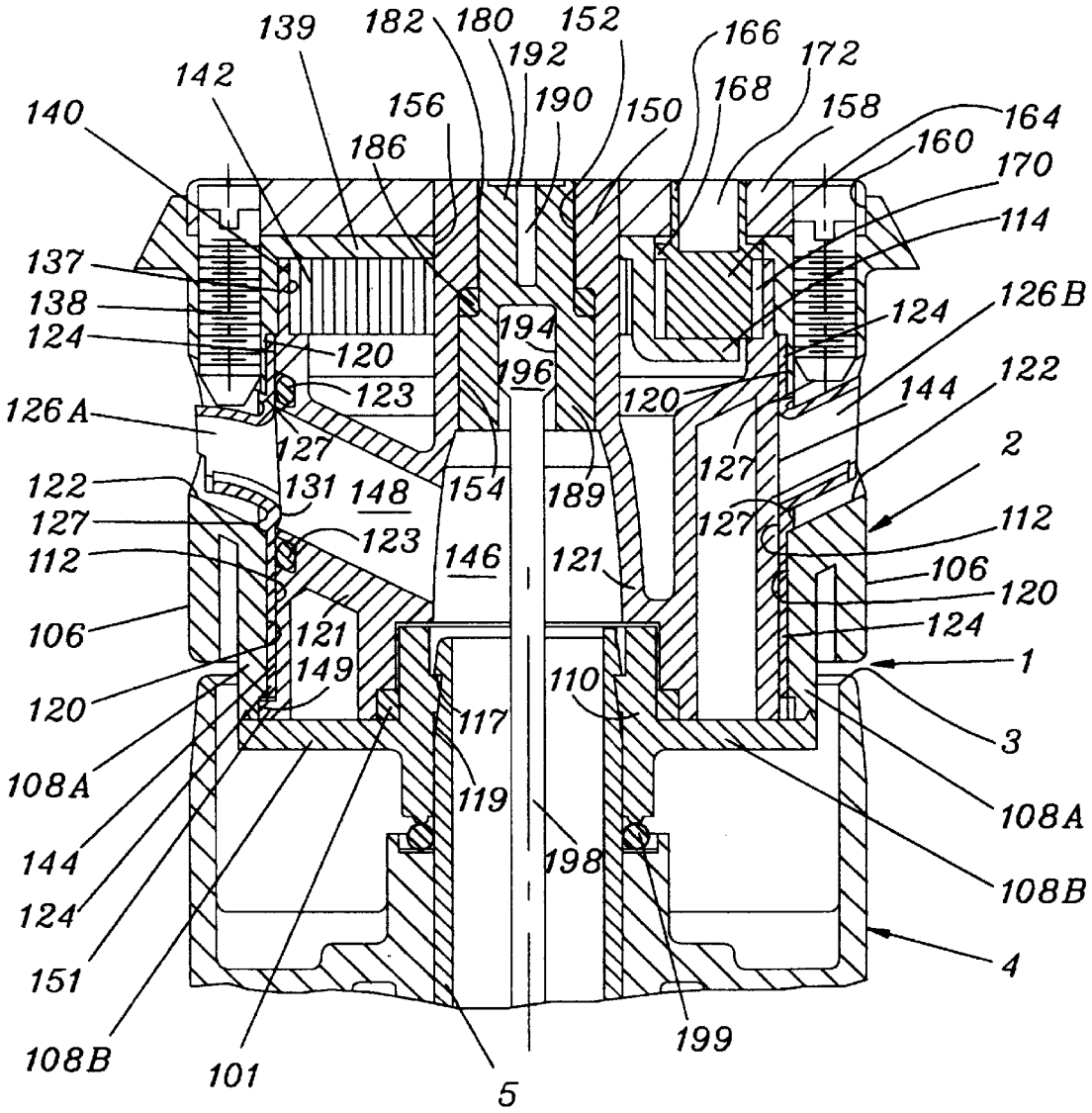
FIG. 5 is a side view in section of the upper part of an alternate configuration of a rotary drive sprinkler taken along the line 5—5 of FIG. 6 having a plurality of nozzles around the outside of a nozzle housing individually selectable by rotating an internal supply port member showing the nozzle housing assembly mounted on the top of a riser; to provide a clear showing of the nozzle set, the line 5—5 has been offset to pass radially through the center of the nozzle set.
Figure 6:
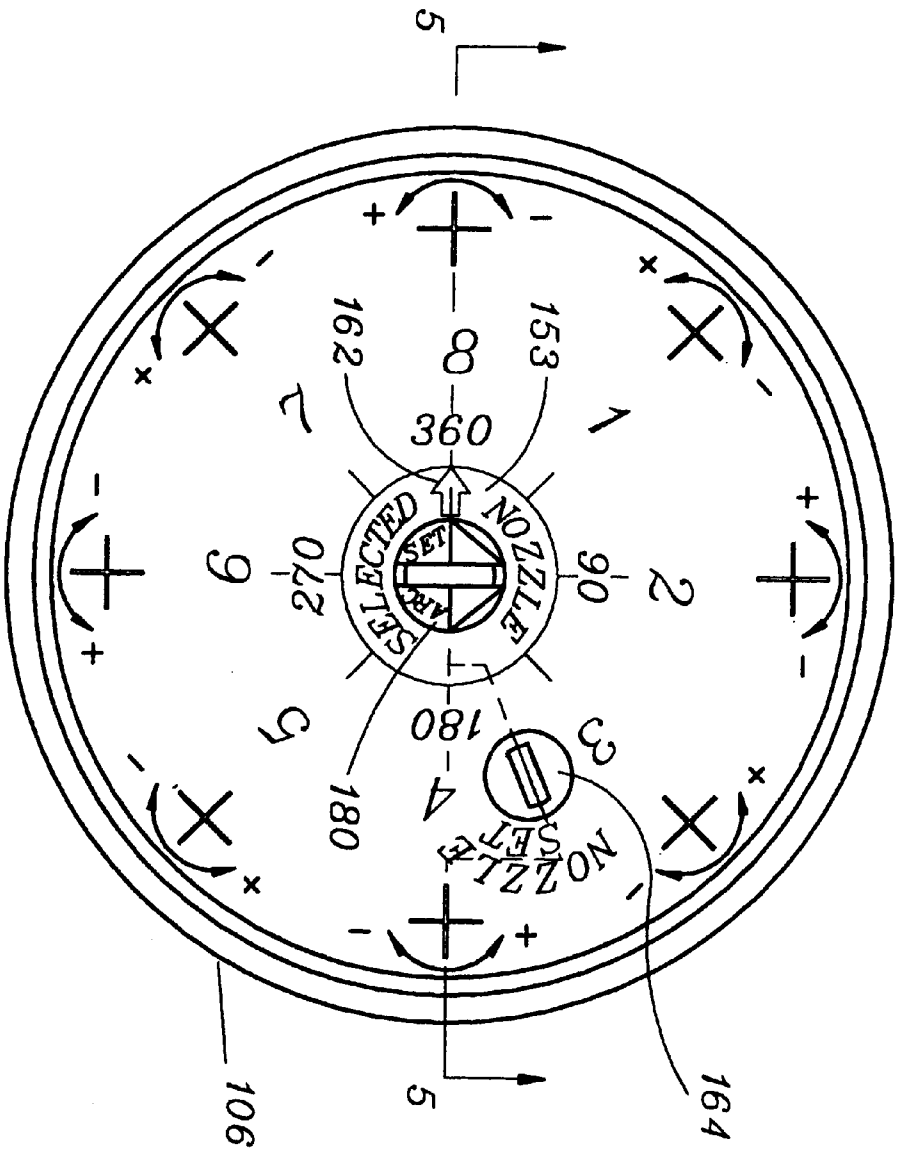
FIG. 6 is a top view of the alternate configuration of the rotary drive sprinkler shown in FIG. 5.

Referring to FIG. 5 and FIG. 6 of the drawings, an upper portion of a rotatable sprinkler 1 is shown having a cylindrical nozzle housing assembly 2 mounted for rotation on top of a riser assembly 4. The riser assembly 4 has an opening 3 at its upper end for a nozzle housing assembly output drive shaft 5 to exit the riser assembly 4 and be connected to the nozzle housing assembly 2. Another arc set indicating and setting mechanism is included to set the cylindrical nozzle housing assembly 2 at a specific arc of oscillation.

The cylindrical nozzle housing assembly 2 has an outer cylindrical nozzle housing 106 which has a bottom portion 108A and 108B. The bottom portions 108A and 108B extend into the opening 3 at the upper end of the riser assembly 4 and bottom portion 108B has an opening member 110 extending upwardly therefrom to receive the drive shaft 5 extending from the riser assembly 4. The drive shaft 5 is fixed in the opening member 110 in a manner to be hereinafter described. The bottom portion 108B extends outwardly to connect to 108A to close off the bottom of cylindrical nozzle housing assembly 2. The outer cylindrical nozzle housing 106 has a top plate 139 across the top thereof with a cup 114 therein to be hereinafter described.

The bottom portion 108A is fixed to bottom portion 108B by sonic welding. Other known means can be used to fix these parts together. Drive shaft 5 is fixed in the opening member 110 by a snap fit at 117 and rotationally locked against rotation by a splined connection 119 therebetween. An "O"-ring seal 199 is located between the output drive shaft 5 and part of the riser assembly 4 as a dirt seal.

The interior of the outer cylindrical nozzle housing 106 is formed with a cylindrical surface 120 having a plurality of nozzle outlet openings 122 therearound. A flexible nozzle strip 124 is placed around and against cylindrical surface 120 having a nozzle 126 projecting outwardly therefrom to fit in each nozzle outlet opening 122. Two nozzles 126A and 126B are shown in FIG. 5. In the configuration shown, there is a total of eight (8) nozzles (See FIG. 6).

An inner flow directing rotor chamber 112 is formed within the inside of said flexible nozzle strip 124 and above bottom portion 108B and below the top plate 139. The portion of the inner flow directing rotor chamber 112 below the flexible nozzle strip 124 to bottom portion 108B provides for contacting a part of a rotatable flow directing rotor 121 to be hereinafter described, and the portion of the inner flow directing rotor chamber 112 above the flexible nozzle strip 124 to the top plate 139 provides a cylindrical portion 137 for receiving a part of a flow directing rotor.

A rotatable flow directing rotor 121 is positioned in the inner flow directing rotor chamber 112 with an upper cylindrical flange 140 extending into cylindrical portion 137. The interior of the flange 140 is formed as an internal gear 142.

The rotatable flow directing rotor 121 is formed having an outer cylindrical wall section 144 engaging the inner surface of the flexible nozzle strip 124. A center flow chamber 146 is located above the opening member 110 to receive flow from the hollow drive shaft 5. A flow directing passage 148, angled upwardly, connects the center flow chamber 146 to the outer cylindrical wall section 144 of the rotatable flow directing rotor 121 where the flow directing passage 148 can be circumferentially aligned with the nozzles 126 and the nozzle outlet openings 122.

There is a need to seal between the flow directing passage 148 of the flow directing rotor 121 and the inner surface of the flexible nozzle strip 124 around the selected nozzle. An "O"-ring 123 surrounding the flow directing passage 148 is shown for this purpose; however, other sealing configurations can be used such as a raised ring around the inner surface of the flexible nozzle strip 124 surrounding each of the nozzles and this ring of material can provide a seal when squeezed between the flexible nozzle strip 124 and the surface around the flow directing passage 148.

An "O"-ring seal 101 between lower nozzle housing closure 108B center raised cylinder 110 and the rotatable nozzle selection member 121 is provided so that water-tight sealing of all of the nozzles 126 is not required. It is desirable to have each nozzle 126 be shut when not in use for dirty entry reasons however.

The lower edge of the bottom portion 108A and the lower edge of the outer cylindrical wall section 144 have a cooperating mechanism therebetween for holding the flow directing rotor 121 in a temporary position where flow directing passage 148 is properly aligned with one of the nozzles 126 until force is applied to move the flow directing rotor 121 to another desired nozzle 126.

The cooperating mechanism is a small rounded notch 149 directed inwardly at the lower edge of the bottom portion 108A below and in alignment with each nozzle 126, and a small rounded projection 151 directed outwardly at the lower edge of the outer cylindrical wall section 144 in alignment with the flow directing passage 148. The rounded notch 149 and rounded projection 151 are sized to engage when the flow directing passage 148 is properly aligned with a nozzle 126.

This engagement of a rounded projection 151 and rounded notch 149 provides a "feel" for the person selecting a desired nozzle.

The cylindrical nozzle housing assembly 2 has a top as shown in FIG. 2. A recess 160 extends around the upper end of the cylindrical nozzle housing 106 and receives a rubber cover 158. The top plate 139 provides rigidity for the rubber cover 158.

The rotatable flow directing rotor 121 has a cylindrical member 150 extending upwardly from the flow chamber 146. The cylindrical member 150 has a smaller cylindrical opening 152 in the upper part thereof forming an annular face 153 at the top, and a larger aligned cylindrical opening 154 in the lower part thereof. The cylindrical member 150 extends through a cylindrical opening 156 in the top plate 139 to the top of the rubber cover 158.

The upper annular face 153 of the cylindrical member 150 of the flow directing rotor 121 has a plurality of markings (shown as numbers) on the top of the rubber cover around the annular face 153 indicating the location of each of the nozzles 126 around the nozzle housing 106. The upper annular face 153 has a marking 162 thereon for pointing at the location of the flow directing passage 148 and which, when directed at a nozzle location marking, indicates the nozzle 126 aligned for use.

A nozzle set actuating cylindrical member 164 has a cylindrical portion 166 at its top extending to the top of the rubber cover 156. A mid-portion is formed as a cylindrical flange 168 which is mounted in an opening in the top plate 139 above the cup 114 formed in the top plate 139. The lower part of the cylindrical member 164 is positioned in the cup 114 and formed as a gear 170. The outer side of the cup 114 is cut off to permit the teeth of gear 170 to mesh with the teeth of internal gear 142 on flange 140 of rotatable flow directing rotor 121. The cylindrical portion 166 has a flow directing recess 172 to receive a key (or flat screwdriver) for applying a force to turn the rotatable flow directing rotor 121, through gear 170 and internal gear 142, within the inner flow directing rotor chamber 112 to align the flow directing passage 148 with a designated nozzle 126 by pointing the marking 162 (shown as an arrowhead) on the annular face 153 at a marking indicating the location of a desired nozzle 126. FIG. 2 shows the arrowhead 162 pointing to the number 8 which is the nozzle 126A.

The arc set indicating and setting mechanism shown in FIG. 5 includes an arc set indicating cylinder member 180 having an upper smaller section 182 with a rotating fit in smaller cylindrical opening 152 in the rotating flow directing rotor 121. The arc set indicating cylinder member 180 has a lower larger section 184 with a rotating fit in larger cylindrical opening 154. An "O"-ring 186 is positioned between the arc set indicating cylinder member 180 and the interior of the cylindrical member 150 of the rotating flow directing rotor 121. This location of the "O"-ring 186 is where the larger and smaller openings of cylindrical member 150 meet and the larger and smaller sections of the indicating cylinder member 180 meet.

The arc set indicating cylinder member 180 has a recess 190 in the top thereof to receive a key (or flat screwdriver) for turning it. The recess 190 has an arrowhead 192 formed at one end to point to numbers around the arc set indicating member 180 to indicate the arc of oscillation which has been set, or the change of oscillation being set. The arc set indicating cylinder member 180 has an elongated adjusting slot 194 at the bottom thereof to receive a mating flattened end 196 of an angular positioning shaft 198. The angular positioning shaft 198 extends into the hollow drive shaft 5 of the riser assembly 4. These shafts, hollow output drive shaft 5 and angular positioning shaft 198 are connected to a mechanism to control the arc of oscillation set.

Such an arc set control mechanism is shown in U.S. Pat. No. 4,901,924, issued Feb. 20, 1990, and U.S. Pat. No. 5,417,370, issued May 23, 1995, and these patents are incorporated herein by reference as though fully set forth.

Figure 7:
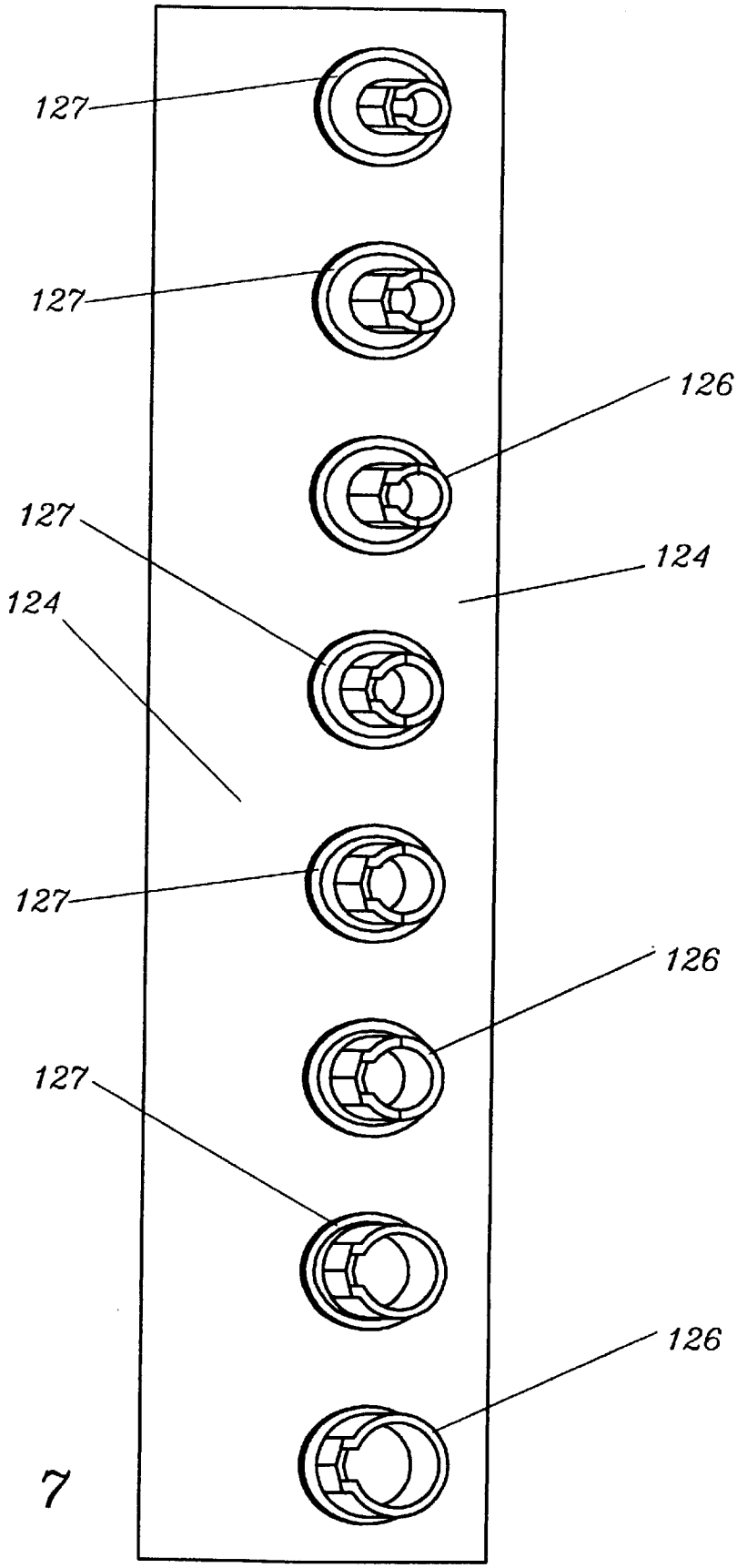
FIG. 7 is a view showing a nozzle strip used in FIG. 5 which is molded of flexible material having eight nozzles for circumferential positioning.

The flexible nozzle strip 124 has each nozzle 126 formed as desired. While shown in FIG. 7 as a series of nozzles 126 from a small nozzle to a large nozzle, other sequences can be formed. Further, while one large flexible nozzle strip 124 has been shown, a plurality of smaller flexible nozzle strips can be placed around the cylindrical surface 120 of nozzle housing 106 to achieve desired flow characteristics in a watering stream. Two half strips 201 and 203, as shown in FIG. 9, could be used with one half colored one color, such as red, and with the other half strip colored another color, such as green. The colors could represent a group of nozzles for a given range and precipitation rate or stream elevation angle, such as a low angle series for windy conditions, or flow rate series for different arc settings. For ease of assembly and to center a nozzle 126 in a nozzle outlet opening 122, a raised rib 127 is placed around each nozzle 126 to fit into a selected nozzle outlet opening 122.

Further, each nozzle 126 can be formed to react differently with use of a stream deflector screw 138. A stream deflector screw 138 is located above each nozzle outlet opening 122 to effect the stream passing through each nozzle 126 in the nozzle outlet opening 122. In FIG. 5, the nozzle 126A has been formed to direct a stream substantially outward at an upward angle. This nozzle 126A has a curved portion 131 formed where it is attached to the flexible nozzle strip 124. This permits the nozzle 126A to bend throughout its length to reduce the stream elevation exit angle from the nozzle housing 106 when acted upon by its cooperating stream deflector screw 138. In FIG. 5, the nozzle 126B extends outwardly and upwardly at a straight angle from the flexible nozzle strip 124. This nozzle will bend mainly from the top when acted upon by its cooperating stream deflector screw 138 to deflect the stream downwardly more and flatter with more breakup and stream fallout in closer to the sprinkler.

Figure 8:
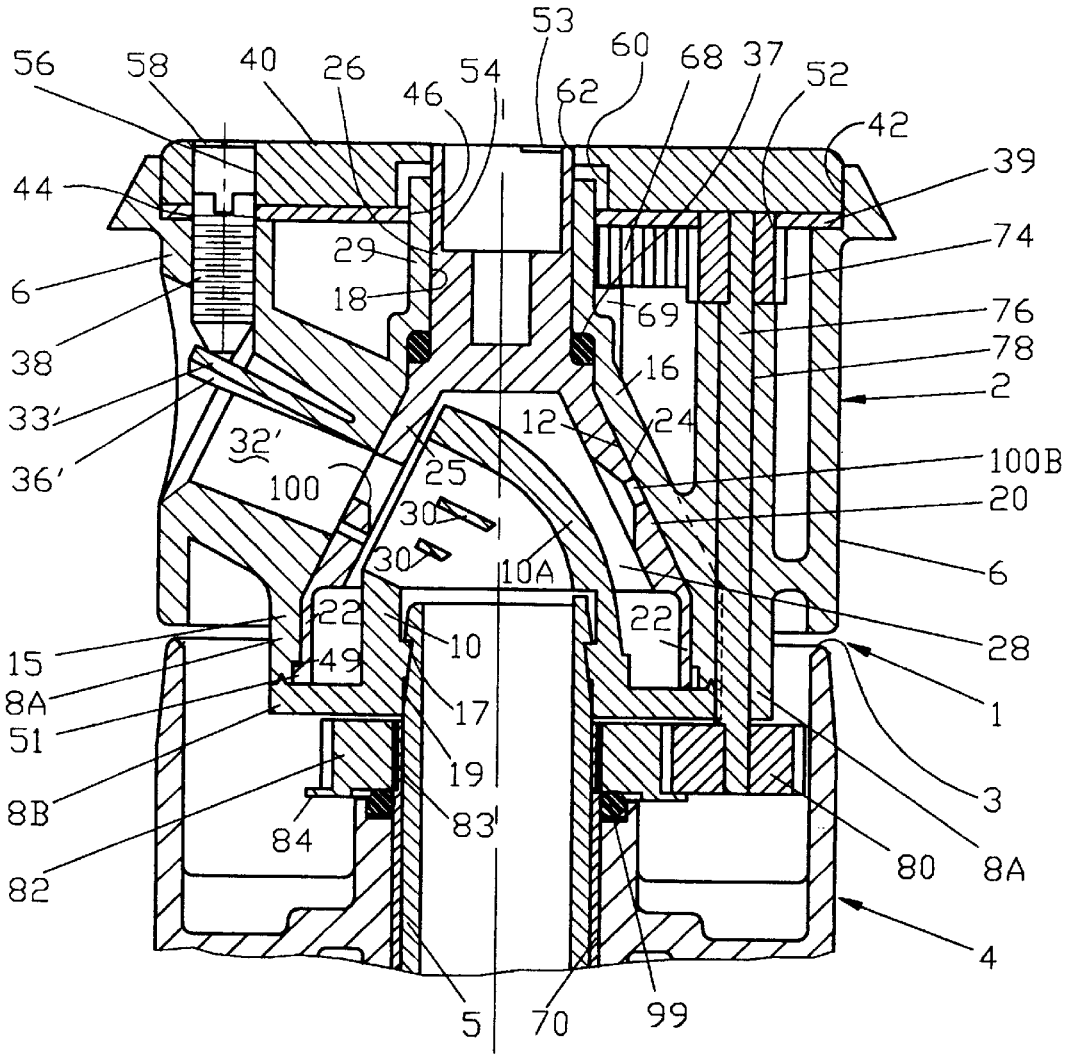
FIG. 8 is a view similar to FIG. 1 where the stream outlet opening is formed as a part of the housing without a seal insert; the sealing is obtained by the pressure load against the softer flexible material of the rotor pressing it against the inner surface of the housing.

Referring to FIG. 8 of the drawings, a modification of the upper portion of the rotatable sprinkler of FIG. 1 is shown. This modification includes forming a nozzle stream outlet opening 32' as part of the housing 6, thus eliminating the separate seal retention insert 34 and the seal 35 in FIG. 1. The stream outlet opening 32' has a stream deflector 33' molded with the housing 6. This stream deflector 33' has a concave curved surface 36' facing the stream flowing from the cooperating nozzle 100. Other curvatures can be used to shape a nozzle stream. Screw 38 controls the deflector 33'.

The rotatable nozzle rotor 20 is formed of a flexible material which will let it flex slightly under pressure from within the rotatable nozzle rotor 20 against the inner surface of the nozzle rotor chamber 12, thereby sealing around a nozzle 100.

The remainder of the FIG. 8 is exactly as shown in FIG. 1.

While the principles of the invention have now been made clear in illustrative embodiments, it will become obvious to those skilled in the art that many modifications in arrangement are possible without departing from those principles. The appended claims are therefore intended to cover and embrace any such modifications, within the limits of the true spirit and scope of the invention.

What is claimed is:

1. A rotary drive sprinkler comprising a sprinkler housing for receiving a supply of water, a nozzle assembly for directing water therefrom, said nozzle assembly having an outer cylindrical housing with a single water stream outlet opening, an internal nozzle rotor having a plurality of nozzle openings therearound, said internal nozzle rotor having a water flow chamber therein, said nozzle assembly having a rotor chamber, said internal nozzle rotor being mounted for rotation in said rotor chamber, said water flow chamber directing water to each nozzle opening, said water stream outlet opening being open to the rotor chamber, said internal nozzle rotor can be turned within said rotor chamber with respect to said nozzle housing to align a specific nozzle opening with the single water stream outlet opening, said plurality of nozzle openings being circumferentially aligned with said single water stream outlet opening so that each nozzle can be selected for operation.

2. A rotary drive sprinkler comprising a sprinkler housing for receiving a supply of water, a nozzle assembly for directing water therefrom, said nozzle assembly having an outer cylindrical housing with a single water stream outlet opening, an internal nozzle rotor having a plurality of nozzles therearound, said nozzle assembly having a rotor chamber, said rotor chamber having a conical shape, said internal nozzle rotor being mounted for rotation in said rotor chamber, said internal nozzle rotor having a matching conical shape to mate with said conical shape of said rotor chamber, said water stream outlet opening being opened to the rotor chamber, said internal nozzle rotor can be turned within said rotor chamber with respect to said outer cylindrical housing to align a specific nozzle with the single water stream outlet opening, said plurality of nozzles being circumferentially aligned with said single water stream outlet opening so that each nozzle can be selected for operation.

3. A rotary drive sprinkler comprising a sprinkler housing for receiving a supply of water, a nozzle assembly for directing water therefrom, said nozzle assembly having an outer cylindrical housing with a single nozzle stream opening, an internal nozzle rotor having a plurality of nozzles therearound, said nozzle assembly having a rotor chamber, said internal nozzle rotor being mounted for rotation in said rotor chamber, said nozzle stream opening being opened to the rotor chamber, said internal nozzle rotor can be turned within said rotor chamber with respect to said nozzle housing to align a specific nozzle with the single nozzle stream opening, said plurality of nozzles being circumferentially aligned with said single nozzle stream opening so that each nozzle can be selected for operation, wherein said rotor chamber is conical, and said internal nozzle rotor is conical to mate with said rotor chamber.

4. A rotary drive sprinkler comprising a sprinkler housing for receiving a supply of water, a nozzle assembly for directing water therefrom, said nozzle assembly having an outer cylindrical housing with a single nozzle stream opening, an internal nozzle rotor having a plurality of nozzles therearound, said nozzle assembly having a rotor chamber, said internal nozzle rotor being mounted for rotation in said rotor chamber, said nozzle stream opening being opened to the rotor chamber, said internal nozzle rotor can be turned within said rotor chamber with respect to said nozzle housing to align a specific nozzle with the single nozzle stream opening, said plurality of nozzles being circumferentially aligned with said single nozzle stream opening so that each nozzle can be selected for operation, wherein said outer cylindrical housing has a top thereon, said internal nozzle rotor having an upwardly extending cylindrical extension for turning it, said upwardly extending cylindrical extension extending through the top of said outer cylindrical housing.

5. A rotary drive sprinkler as set forth in claim 4 wherein said upwardly extending cylindrical extension has indices therearound on the top indicating the nozzles on the internal nozzle rotor, said upwardly extending cylindrical extension having an indicator for pointing to the selected nozzle index.

6. A rotary drive sprinkler as set forth in claim 4 wherein said sprinkler has an arc set indicating mechanism, said arc set indicating mechanism having an indicating cylinder in said cylindrical housing for indicating the arc of oscillation set, said indicating cylinder extending through the top of said outer cylindrical housing, said indicating cylinder has indices therearound on the top indicating the angle of rotation set, said indicating cylinder having an arrowhead for pointing to the selected arc set.

7. A rotary drive sprinkler as set forth in claim 5 wherein said sprinkler has an arc set indicating mechanism, said arc set indicating mechanism having an indicating cylinder in said cylindrical housing for indicating the arc of oscillation set, said indicating cylinder extending through the top of said outer cylindrical housing, said indicating cylinder has indices therearound on the top indicating the angle of rotation set, said indicating cylinder having an arrowhead for pointing to the selected arc set.

8. A rotary drive sprinkler comprising a sprinkler housing for receiving a supply of water, a nozzle assembly for directing water therefrom, said nozzle assembly having an outer cylindrical housing with a single nozzle stream opening, an internal nozzle rotor having a plurality of nozzles therearound, said nozzle assembly having a rotor chamber, said internal nozzle rotor being mounted for rotation in said rotor chamber, said nozzle stream opening being opened to the rotor chamber, said internal nozzle rotor can be turned within said rotor chamber with respect to said nozzle housing to align a specific nozzle with the single nozzle stream opening, said plurality of nozzles being circumferentially aligned with said single nozzle stream opening so that each nozzle can be selected for operation , said internal nozzle rotor has a water flow chamber therein, said water flow chamber directing water flow to each nozzle.

9. A rotary drive sprinkler comprising a sprinkler housing For receiving a supply of water, a nozzle assembly for directing water therefrom, said nozzle assembly having an outer cylindrical housing with a nozzle stream opening for receiving a nozzle stream, an internal nozzle rotor having a plurality of nozzles therearound, said nozzle assembly having a rotor chamber, said internal nozzle rotor being mounted in said rotor chamber, said internal nozzle rotor having a flow chamber therein to direct water to said nozzles of said internal nozzle rotor, said internal nozzle rotor can be rotatably turned with respect to said nozzle housing to align a specific nozzle with the nozzle stream opening for directing a nozzle stream to the nozzle stream opening.

10. A rotary drive sprinkler as set forth in claim 9 wherein said rotor chamber is conical in shape, and said internal nozzle rotor is conical to mate with said rotor chamber.

11. A rotary drive sprinkler as set forth in claim 10 wherein said conical nozzle rotor has an outer surface at an angle of to said nozzle stream opening.

12. A rotary drive sprinkler comprising a sprinkler housing for receiving a supply of water, a nozzle assembly for directing water therefrom, said nozzle assembly having an outer cylindrical housing with a single water stream outlet opening, an internal nozzle rotor having a plurality of nozzle openings therearound, said internal nozzle rotor having a water flow chamber therein, said nozzle assembly having a rotor chamber, said internal nozzle rotor being mounted for rotation in said rotor chamber, said water flow chamber directing water to each nozzle opening, said water stream outlet opening being open to the rotor chamber, said internal nozzle rotor can be turned within said rotor chamber with respect to said outer cylindrical housing to align a specific nozzle opening with the single water stream outlet opening, said plurality of nozzle openings being circumferentially aligned with said single water stream outlet opening so that each nozzle can be selected for operation.

13. A rotary drive water sprinkler having a riser assembly, a drive shaft extending from the top of said riser assembly, a nozzle housing assembly, said nozzle housing assembly having a housing connected to said drive shaft for rotation therewith, said nozzle housing having a cylindrical outer surface, said nozzle housing having an inner wall spaced inwardly from said cylindrical outer surface, a flow passage extending between said cylindrical outer surface and said inner wall, said flow passage having an exit at the cylindrical outer surface, a nozzle selection member being mounted internally of the inner wall of said nozzle housing for rotation, said nozzle selection member having a movable wall with a multiplicity of individual nozzles therearound, said individual nozzles being positioned on said wall of said nozzle selection member so that each nozzle becomes aligned with said flow passage as the nozzle selection member is rotated to achieve a nozzle stream.

14. A rotary drive water sprinkler as set forth in claim 13 wherein said inner wall is positioned downwardly at an angle toward said cylindrical outer surface, said wall of said nozzle selection member mating with said nozzle housing inner wall.

15. A rotary drive water sprinkler as set forth in claim 13 wherein said flow passage extends at an angle to its aligned nozzle.

16. A rotary drive water sprinkler as set forth in claim 13 wherein a stream deflector is located in said flow passage of said nozzle housing to be movable into said nozzle stream to deflect the nozzle stream downwardly to produce a flattened nozzle stream to obtain a better coverage for a windy day.

17. A rotary drive water sprinkler as set forth in claim 16 wherein said stream deflector is a flat plate extending outwardly from said inner wall.

18. A rotary drive water sprinkler as set forth in claim 17 wherein said plate can have a concave curved surface facing the nozzle stream.

19. A rotary drive water sprinkler as set forth in claim 16 wherein a deflector screw acts to move the outer end of the reflector.

20. A rotary drive sprinkler comprising a sprinkler housing for receiving a supply of water, a nozzle assembly for directing water therefrom, said nozzle assembly having an outer cylindrical housing with a plurality of nozzle stream openings, an internal nozzle member having a plurality of nozzles therearound, one nozzle being placed in each nozzle stream opening, an internal rotatable flow directing rotor, said internal rotatable flow directing rotor having a flow directing passage, said internal rotatable flow directing rotor being rotated to align the flow directing passage with a specific nozzle, a nozzle stream opening in the nozzle housing around the specific nozzle allowing the stream from the specific nozzle to be directed to the outside and radially away from the nozzle housing.

21. A rotary drive sprinkler as set forth in claim 20 wherein said nozzle stream openings are aligned circumferentially around the outer cylindrical housing.

22. A rotary drive sprinkler as set forth in claim 20 wherein said nozzles are made of flexible material, a deflector screw is threadably mounted in said cylindrical housing above each nozzle stream opening, each deflector screw being operable to be moved into its cooperating nozzle stream opening to alter the shape of the nozzle in the cooperating nozzle stream opening.

23. A rotary drive sprinkler as set forth in claim 20 wherein said cylindrical housing has a top thereon, said rotatable flow directing rotor has a cylindrical member extending upwardly to the housing top, said cylindrical member having a pointer to show the nozzle in communication with the flow directing passage.

24. A rotary drive sprinkler as set forth in claim 23 wherein a nozzle selector is accessible from the housing top for turning said rotatable flow directing rotor within the nozzles to select a nozzle.

25. A rotary drive sprinkler as set forth in claim 23 wherein said cylindrical housing has an arc set indicating cylinder member mounted in a cylindrical opening in the center of the upwardly extending cylindrical member of the rotatable flow directing rotor.

26. A rotary drive sprinkler comprising a sprinkler housing for receiving a supply of water, a nozzle assembly for directing water therefrom, said nozzle assembly having an outer cylindrical housing with a plurality of nozzle stream openings therearound, said nozzle stream openings intersect an inner cylindrical surface, a flexible nozzle strip having a plurality of nozzles along its length, said flexible nozzle strip being wrapped within the inner cylindrical surface with each of its nozzles projecting into each nozzle stream opening.

27. A rotary drive sprinkler as set forth in claim 26 having an internal flow directing rotor, said internal flow directing rotor being connected to said supply of water, said internal flow directing rotor having a flow directing passage for directing flow to each of said plurality of nozzles one at a time, said internal flow directing rotor can be rotatively turned to align said flow directing passage with a specific nozzle.

28. A rotary drive sprinkler as set forth in claim 26 wherein said flexible nozzle strip can be formed of a plurality of smaller strips.

29. A rotary drive sprinkler as set forth in claim 28 wherein each of the plurality of flexible nozzle strips is colored to represent a desired flow characteristic.

30. A rotary drive sprinkler comprising a sprinkler housing for receiving a supply of water, a nozzle assembly for directing water therefrom, said nozzle assembly having an outer cylindrical housing with a plurality of nozzle stream openings, one nozzle being placed in each nozzle stream opening, an internal rotatable flow directing rotor, said internal rotatable flow directing rotor having a flow directing passage, said internal rotatable flow directing rotor can be rotated to align the flow directing passage with a specific nozzle.

31. A rotary drive sprinkler as set forth in claim 30 wherein said nozzles are formed on a flexible strip, said flexible strip being placed in said nozzle assembly so that one nozzle is positioned in each nozzle stream opening.

32. A rotary drive sprinkler as set forth in claim 31 wherein said internal rotatable flow directing rotor has an upper internal ring gear for turning it, said cylindrical housing having a top, a rotor actuating member accessible from the top for turning said internal ring gear.

33. A rotary drive sprinkler comprising a sprinkler housing for receiving a supply of water, a nozzle assembly for directing water therefrom, said nozzle assembly having an outer cylindrical nozzle housing with multiple nozzle openings therearound, an internal nozzle selection rotor, said internal nozzle selection rotor having an opening for directing water therefrom, said internal nozzle selection rotor and said nozzle housing can be rotated relative to each other to align a specific nozzle with the opening in the nozzle selection rotor for connecting a selected nozzle to said supply of water.

34. A rotary drive sprinkler comprising a sprinkler housing for receiving a supply of water, a nozzle assembly for directing water therefrom, said nozzle assembly having a plurality of nozzles therearound, said nozzle assembly having an internal nozzle selection rotor, said nozzle assembly having a nozzle selection rotor chamber, said internal nozzle selection rotor being mounted for rotation in said rotor chamber, said nozzles being open to the internal rotor chamber, said internal nozzle selection rotor can be turned with respect to said nozzle housing to align a specific nozzle with the water supply so that each nozzle can be individually selected for operation.

35. A rotary drive sprinkler comprising a sprinkler housing for receiving a supply of water, a nozzle assembly for directing water outwardly therefrom, said nozzle assembly having an outer cylindrical housing, said sprinkler housing directing water to said outer cylindrical housing, an inner nozzle rotor chamber in said outer cylindrical housing, an outlet opening in said nozzle assembly extends from said inner nozzle rotor chamber to the exterior of said outer cylindrical housing for directing water therefrom, a nozzle rotor being positioned in said inner nozzle rotor chamber, said nozzle rotor having a flow chamber therein to receive water, said nozzle rotor having a plurality of nozzles therearound, said nozzle rotor can be turned within said rotor chamber with respect to said outer cylindrical housing to align a specific nozzle with the outlet opening, said plurality of nozzles being circumferentially aligned with said outlet opening so that each nozzle can be selected for operation.

36. A rotary drive sprinkler as set forth in claim 35 wherein said inner nozzle rotor chamber has a conical shape, and said nozzle rotor is conical to mate with said rotor chamber.

37. A rotary drive sprinkler comprising a sprinkler housing for receiving a supply of water, a nozzle assembly mounted on said sprinkler housing, said nozzle assembly having an outer cylindrical housing, said outer cylindrical housing having an inner nozzle rotor chamber, said outer cylindrical housing having a water stream outlet there-through from said inner nozzle rotor chamber for directing water away from said sprinkler housing, a nozzle rotor being mounted in said inner nozzle rotor chamber for rotation, said nozzle rotor having sliding contact with the inside of the inner nozzle rotor chamber, said nozzle rotor having a water flow chamber therein, said nozzle rotor water flow chamber having a plurality of different nozzles therearound to become aligned with said nozzle stream outlet one at a time as the nozzle rotor is rotated.

38. A rotary drive sprinkler as set forth in claim 37 wherein said water flow chamber of said nozzle rotor receives water from said sprinkler housing.

39. A rotary drive sprinkler comprising a sprinkler housing for receiving a supply of water, a nozzle assembly for directing water therefrom, said nozzle assembly having an outer cylindrical housing with a single nozzle stream opening, an internal nozzle rotor having a plurality of nozzles therearound, said nozzle assembly having a rotor chamber, said internal nozzle rotor being mounted for rotation in said rotor chamber, said internal nozzle rotor having an inner flow chamber, a hollow shaft for directing water from the sprinkler housing into said inner flow chamber of said internal nozzle rotor, said nozzle stream opening being open to the rotor chamber, said internal nozzle rotor can be turned within said rotor chamber with respect to said outer cylindrical housing to align a specific nozzle with the single nozzle stream opening, said plurality of nozzles being circumferentially aligned with said single nozzle stream opening so that each nozzle can be selected for operation.

40. A rotary drive sprinkler as set forth in claim 39 wherein said rotor chamber is conical, and said internal nozzle rotor is conical to mate with said rotor chamber.

* * * * *